United States Patent [19]

Sharav

[11] Patent Number: 4,885,921

[45] Date of Patent: Dec. 12, 1989

[54] ACCESSORY FOR DOORS HAVING SUPPLEMENTAL LOCKS

[76] Inventor: Vera Sharav, 142 West End Ave., New York, N.Y. 10023

[21] Appl. No.: 268,488

[22] Filed: Nov. 8, 1988

[51] Int. Cl.[4] ..... B65D 55/14

[52] U.S. Cl. ..... 70/159; 70/416

[58] Field of Search ..... 70/416, 158, 159–162, 70/456 R, 456 B, 458; 292/251.5, 346, 342, 343

[56] References Cited

U.S. PATENT DOCUMENTS

| | | | |
|---|---|---|---|
| 714,686 | 12/1902 | Flint . | |
| 2,138,416 | 11/1938 | Cox . | |
| 2,315,158 | 3/1943 | Markham | 70/63 |
| 2,693,382 | 11/1954 | Teetor | 292/251.5 |
| 3,245,240 | 4/1966 | De Forrest . | |
| 3,263,462 | 8/1966 | Suroff . | |
| 3,414,306 | 12/1968 | Bernstein | 70/416 |
| 3,888,096 | 6/1975 | Huss . | |
| 3,952,564 | 4/1976 | Maines . | |
| 4,055,361 | 10/1977 | Moses . | |
| 4,185,483 | 1/1980 | Lupton . | |
| 4,226,104 | 10/1980 | Oliver . | |
| 4,279,137 | 7/1981 | Cook | 70/416 |

*Primary Examiner*—Robert L. Wolfe

*Attorney, Agent, or Firm*—William D. Hall

[57] ABSTRACT

A cover for the various locks that are often placed a few inches above the door-knob is provided. The cover is an elongated plate spaced from the door and having side-walls extending almost to the door. The cover has a downwardly extending portion that surrounds the shaft of the door-knob and has a hole through the shaft of the door-knob and has a hole through which the door-knob passes when the cover is rotated on its hinges to an open position. A jamming device has an indent for receiving the key or handle of one of the locks on the door. The jamming device bears against the shaft of the door-knob and prevents the key or handle of the lock from turning. Hence, the lock remains locked when the jamming device is used.

20 Claims, 3 Drawing Sheets

ACCESSORY FOR DOORS HAVING SUPPLEMENTAL LOCKS

BACKGROUND OF THE INVENTION

It is commonplace for doors of apartments, houses, and businesses to have, in addition to the usual lock associated with the door-knob, one or more additional locks. These additional locks are usually mounted a few inches above the door-knob and often include a dead bolt lock and/or a chain lock. These various additional locks are somewhat unsightly. Patents have issued for devices that cover a lock. See for example, U.S. Pat. No. 3,888,096 issued June 10, 1975 to Steven J. Huas and entitled Lock-Up Housing for Door Lock. Other patents include:

U.S. Pat. No., 714,686, issued Dec. 2, 1902 to W. G. Flint, entitled Show Case.

U.S. Pat. No., 4,226,104 issued Oct. 7, 1980 to Melvin D. Oliver, entitled Removable Protector for Locks.

U.S. Pat. No., 3,952,564, issued Apr. 27, 1976, to Peter Maines, entitled Protective Device for Door Knobs and the Like.

U.S. Pat. No., 3,414,306 issued Dec. 3, 1968 to A. A. Bernstein entitled Door Knob, Lock and Slide Bolt Protector.

U.S. Pat. No., 3,245,240 issued Apr. 12, 1966 to W. E. De Forrest, entitled Knob Protector.

Present dead bolt locks are subject to problems in that they may be opened during the night by persons having master keys, by persons experienced in picking locks, etc. A patent has issued which attempts to solve this problem by placing a jamming device between the handle of the lock and the shaft of the door-knob, see U.S. Pat. No., 4,185,483, issued Jan. 29, 1980, to Stephanie Lupton et al. entitled Door Locking Device.

SUMMARY OF THE INVENTION

The invention provides a cover for the various locking devices that may be mounted a few inches higher than the door-knob. This cover is adjacent to but spaced from the door and has sidewalls extending toward the door and at least partially surrounds the various locking devices that are above the door-knob. The cover is connected to the door by a hinge, or other mounting device, which enables the cover to move away from its normal position so that there is manual access to the various locks. The cover and at least one of its sidewalls preferably extends beyond the edge of the door and covers a small part of the door jamb that is adjacent to the door and its locks.

The cover includes an extension that extends inward toward the door and around the shaft of the door-knob. This extension defines a large hole through which the door-knob passes when the cover is rotated on the hinges, away from its normal position, so that there is manual access to the various locks.

The invention also contemplates that a small hanger may be attached to the door just above the door-knob, to enable small pieces of note paper, or other objects, to be held in that location.

Furthermore, a device to prevent the dead bolt lock from being opened from the outside of the apartment, or building is provided. A jamming device composed of material having limited flexibility has an indent for receiving the handle, or key, that extends away from the inside wall of the door. The indent may simply be a depressed area of correct shape to receive the handle or key of the lock, or it may be a slot clear through the jamming device and extending from one wall of the jamming device to the interior of that device. This jamming device has a curved surface that engages the shaft of the door-knob. The jamming device, therefore, prevents the handle (or key) of the dead bolt lock from rotating, and thus prevents the door from being opened by someone outside the apartment or building that is protected by the lock.

DETAILED DESCRIPTION OF THE INVENTION

Figure 1:
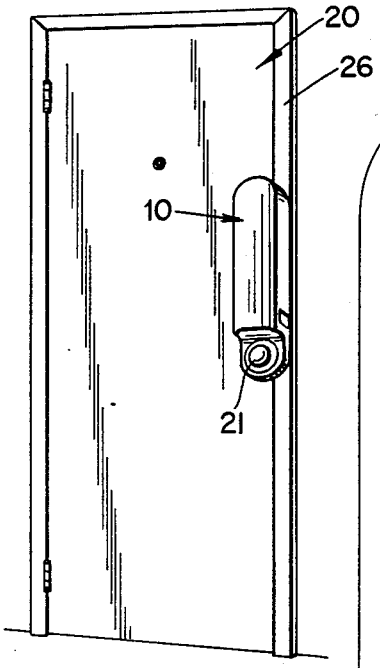
FIG. 1 is a front view of a door with my new cover on it.
Figure 2:
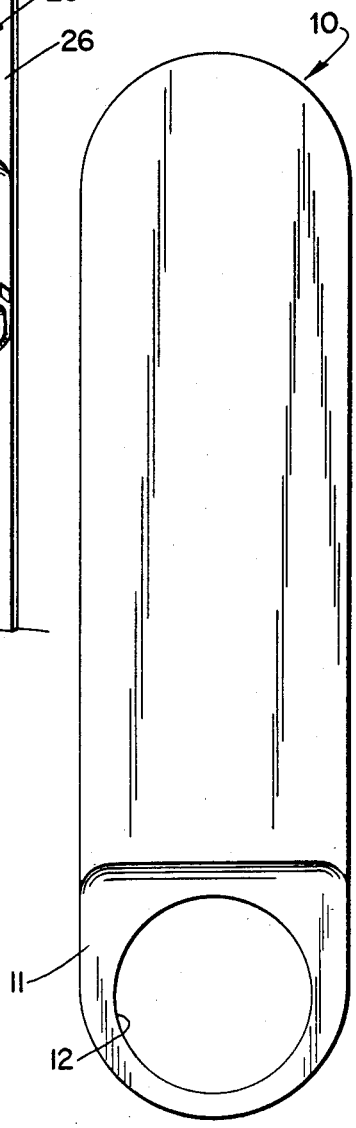
FIG. 2 is a front view of my new cover per se.
Figure 3:
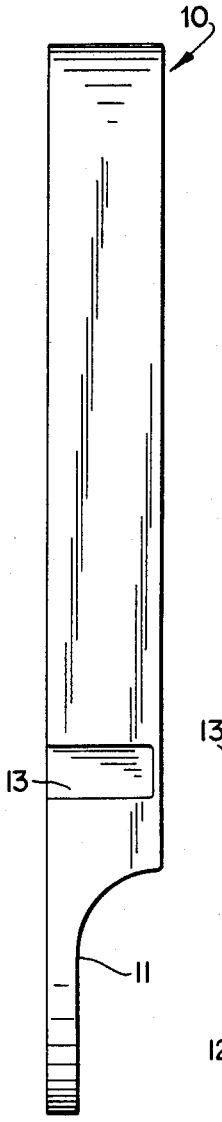
FIG. 3 is a side view of my new cover per se.

In FIG. 1, I show a conventional door 20 such as is used in an apartment house, together with a door-knob 21, a door jamb 26, and my new cover 10.

FIGS. 2 to 6 show the details of the new cover, per se. The cover 10 is generally an elongated device having side walls that extend toward the door and surround the various locks as shown in FIG. 7.

Figure 4:
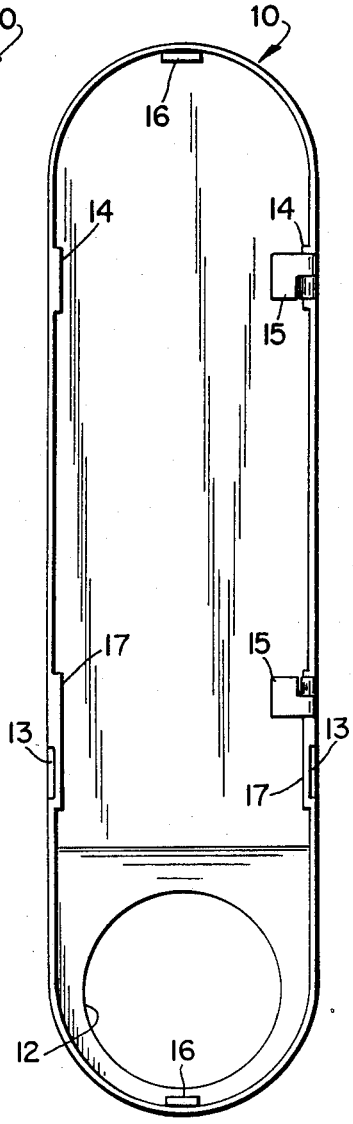
FIG. 4 is a back view of my new cover per se.
Figure 5:
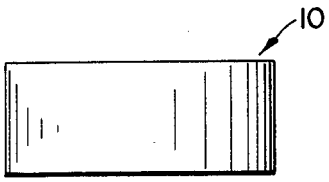
FIG. 5 is a top or plan view of my new cover per se.
Figure 6:
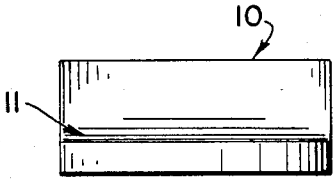
FIG. 6 is a bottom view of my new cover per se.

The cover 10 includes an extension 11 that, in use, extends inwardly toward the door and defines a hole 12 that is larger than the door-knob. The cover 10 has reinforced areas 14 to which hinges 15 may be attached. The hinges 15 are shown in FIG. 4 as attached to the reinforcement 14 on the right-hand side wall of cover 10. For some doors, however, the hinges would be attached to the reinforcement 14 on the left-hand side wall of cover 10 (FIG. 4).

The cover 10 also includes two permanent magnets 16 that are attracted to the door 10. It is customary for doors of apartment houses to be made of, or to include a sheet of, ferromagnetic material which attracts a magnet. Such a door is contemplated for use with my invention.

Figure 7:
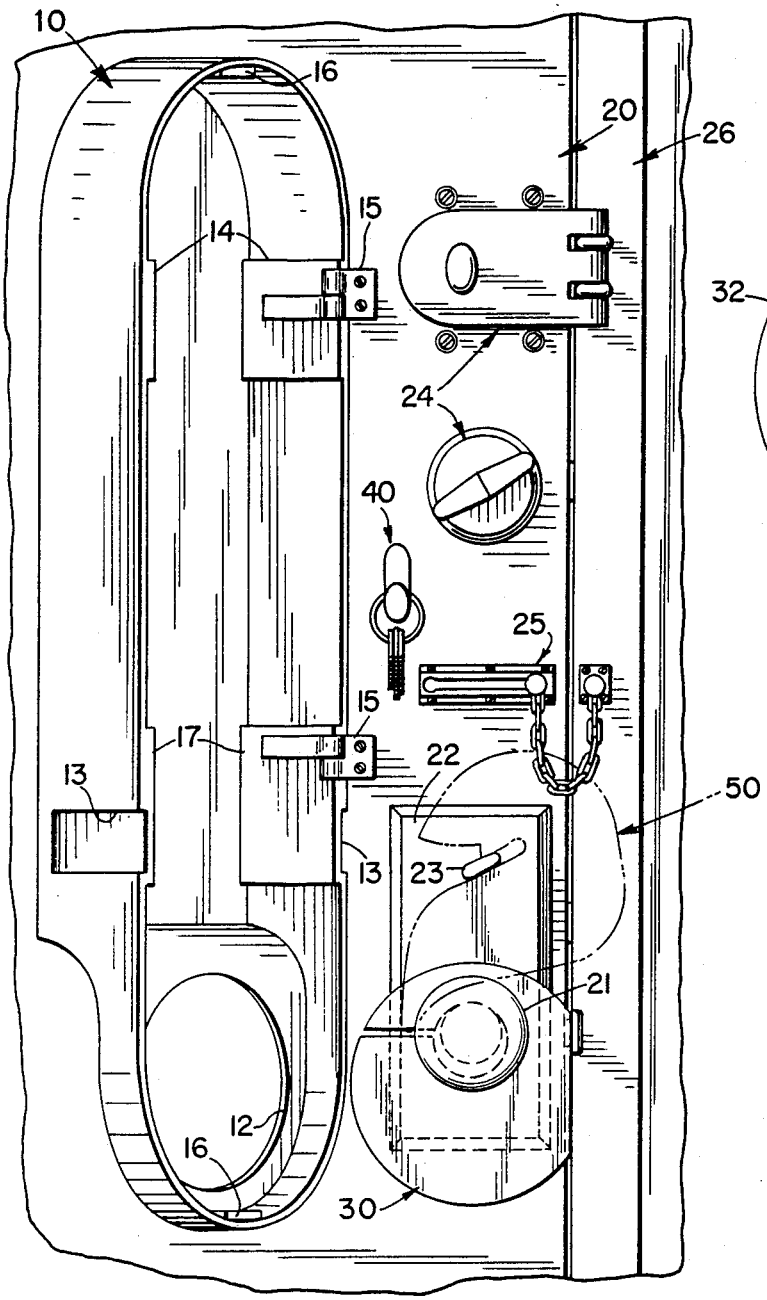
FIG. 7 is a front view of a limited portion of a typical door jamb with my new cover attached to the door.

FIG. 7 illustrates my invention installed on a door 20. The door 20 has dead bolt locks 24, and a chain lock 25. A further lock, which may be unlocked from the outside of the apartment, by a key, has a handle 23 for locking and unlocking the lock. Each of the four locks 23, 24 and 25, shown in FIG. 7, cooperates with the door jamb to secure the door against intruders.

A hanger 40 has a magnet 42 which will hold the hanger 40 on the metal door 20. The hanger has a hook 41 which is adapted to hold small objects such as keys, a sheet of paper, etc.

The indents 13 in the sidewalls of the cover 10 permit a human finger to swing the cover 10 from its normally closed position (see FIG. 1) to its open position as shown in FIG. 7. The magnets 16 tend to hold the cover plate 10 against the door 20, but, nevertheless, a human finger may readily overcome the attractive force of the magnets 16 to permit the cover 10 to be moved to an open position.

When the cover plate 10 is rotated about the hinges 15 to its open position shown in FIG. 7, the door-knob 21 remains untouched due to the large hole 12, in extension 11.

Figure 8:
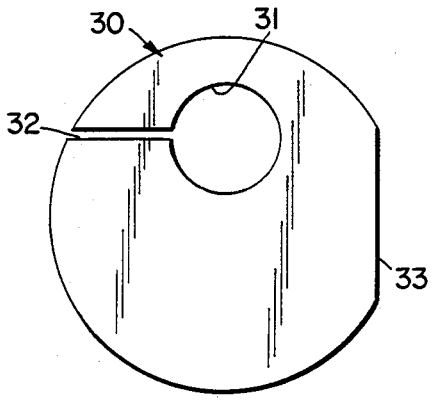
FIG. 8 is a front view of a slotted plate that may be used with my invention.
Figure 9:
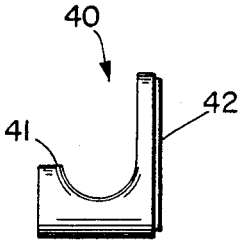
FIG. 9 is a perspective view of a hook that may be used with my invention.

The slotted plate 30 of FIG. 8 is normally placed around the shaft of door-knob 21 as shown in FIG. 7. This plate 30 is positioned between the extension 11 and the door. The plate 30 may have the same color as the cover 10 to thereby present one continuous color for the portion of the door extending from a short distance below the door-knob 21 to a position above the locks 24.

The plate 30 is sufficiently flexible that it may be slipped around the shaft of the door-knob 21. The upper and lower portions of plate 30 may be spread apart to enlarge the slit 32 and enable the shaft of the door-knob to pass through slit 32 to the central hole 31. When the plate 30 is positioned around the shaft of the door-knob 21, the various portions of plate 30 spring back to the normal flat condition of the plate. The plate 30 may then be rotated until its straight edge 31 aligns itself with the edge of door 20.

If it is desired to prevent persons, who are outside of the apartment, and who have a key to lock 23, from opening the door 20, the jamming device 50 shown in FIGS. 7, and 10 to 12, may be used.

Figure 10:
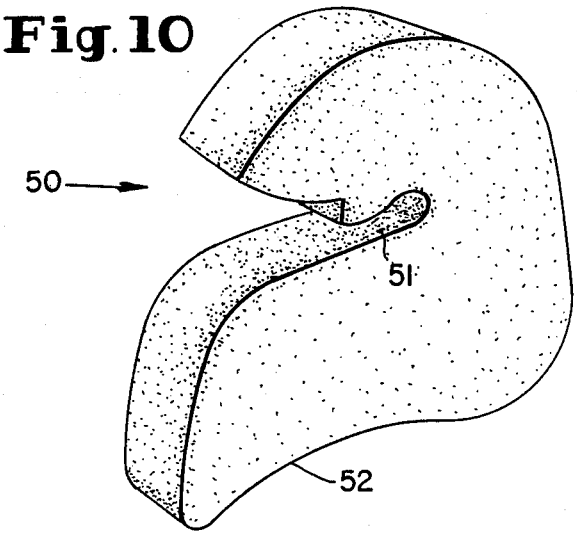
FIG. 10 is a perspective view of my new lock jamming device.
Figure 11:
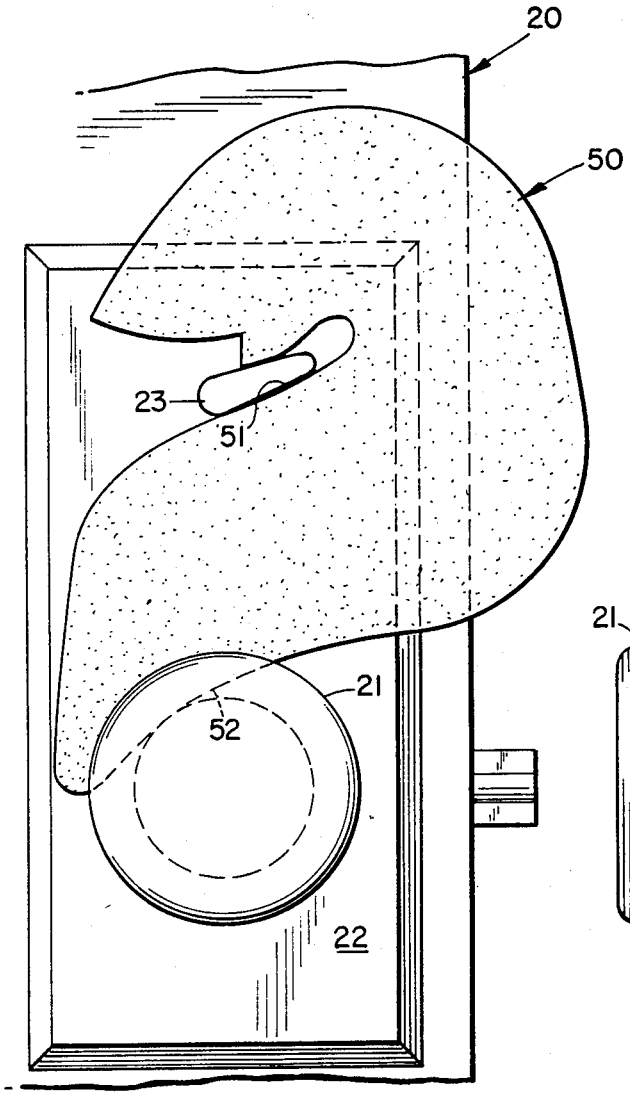
FIG. 11 is a front view of a door with my lock jamming device in place.
Figure 12:
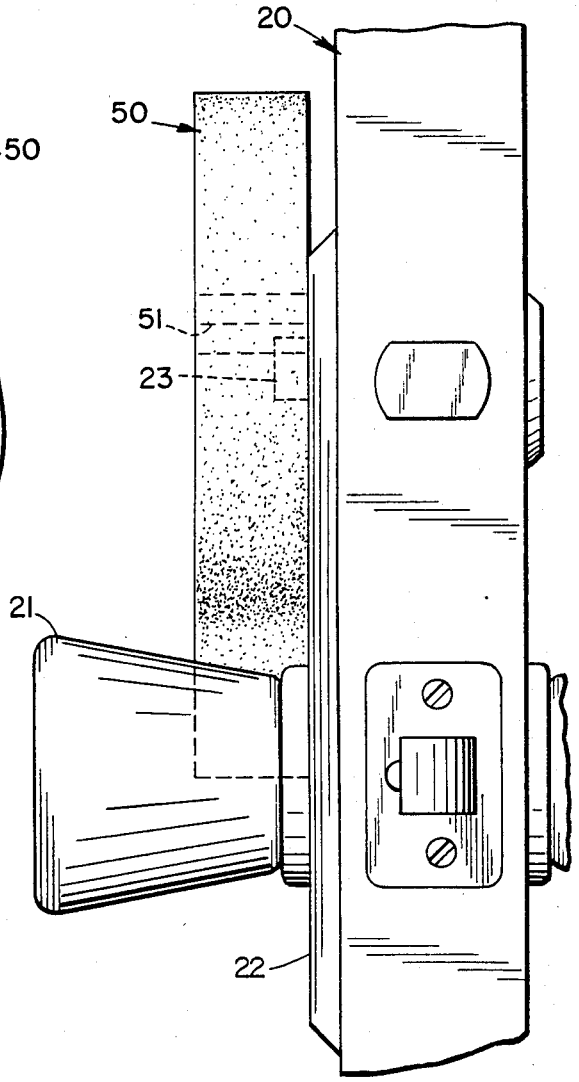
FIG. 12 is a side view of the door with the lock jamming device in place.

The jamming device 50 may be made of any suitable material, but rubber-like materials, or plastics are preferred. The jamming device 50 has a slot 51 for receiving the handle 23 (FIG. 3) of a lock. The jamming device has a lower surface 52 which tapers downwardly in the left-hand direction, as shown in FIGS. 10 and 11. In the event someone outside of the apartment attempts to open the lock with a key, the handle 23 of the lock will rotate with the key; but such rotation will be prevented since the lower surface 52 of jamming device 50 will bear against the shaft of the door-knob 21.

The jamming device 50 may have a permanent magnet (not shown) embedded in it so that when it is not in use, it may be placed flush with the door where the magnet will hold it on the door.

The outside surfaces of cover 10, and plate 30, may have decorations placed on them, if desired. The decorations may have any desired form including pictures, colored stripes, physical objects, etc.

OPERATION

During normal day-time usage, my cover plate 10 does not interfere with the operation of the door. For example, the door-knob 21 of FIG. 1 is readily accessible to the human hand so that the door 20 may be opened and closed. If, however, it is desired to open the door 20 while the various locks 23, 24 and 25 are locked, my cover 10 may be readily swung about its hinges 15 and access thereby gained to the several locks. If no one remains in the apartment, it is not necessary to close cover 10 after the door is opened. When, however, the person who dwells in the apartment returns and opens the door the various locks may be locked and the cover 10 closed. If it is also desired to use the jamming device 50 it may be placed in jamming position before the cover 10 is closed.

I claim to have invented:

1. A device for obscuring the portion of a door that is located a short distance above a door-knob that has a shaft, comprising:

an element which when located adjacent to a door and spaced in front of the portion of the door above the door-knob will at least partially obscure visibility of that portion of the door, and mounting means for positioning said element spaced from said door and in front of said portion of the door to at least partially obscure visibility of said portion, said mounting means including means allowing said element to be moved from said position to enable manual access to said portion of said door, said element having an extension which when said element is in said position extends inwardly toward the door and downwardly and at least partially around the shaft of the door-knob, said extension having a hole therethrough which is larger in diameter than the door knob, the plane of said extension being between the plane of the door knob and the plane of the door thereby exposing the door knob to manual operation even though said element is in said position.

2. A device as defined in claim 1 in which said mounting means comprises at least one hinge which allows said element to be swung away from said position to thereby permit manual access to said portion of the door.

3. A device as defined in claim 1 which includes means for tending to hold said element in said position once it is placed in said position.

4. A device as defined in claim 1 which includes a magnet for tending to hold said element in said position once it is placed in said position.

5. A device as defined in claim 1 in which said element has side walls that, when said element is in said position, extend from the element inwardly to at least partly surround the space between said element and said portion of said door.

6. A device as defined in claim 5 in which said mounting means comprises at least one hinge.

7. A device as defined in claim 6 having magnetic means for temporarily holding said element in said position once it is placed in said position.

8. A device as defined in claim 1, comprising a flat piece having a circular hole therethrough at least as large in diameter as the diameter of the shaft for the door-knob, said flat piece having a slit therein extending from said circular hole to the outer periphery of the flat piece, said flat piece comprising flexible means so that the flat piece may be inserted around said shaft of the door knob by passing that shaft through said slit.

9. The combination of a door having a door-knob with a shaft for the door-knob, and a cover element for at least partially obscuring the visibility of the portion of said door extending above said door-knob, mounting means for said cover element enabling said cover element to be positioned in front of said portion to at least partially obscure the visibility of said portion without obscuring or impairing access to the door knob, said mounting means including means for permitting said cover element to be removed from said position so that said portion of the door is readily available to a human hand.

10. The combination of claim 9 including an extension of said cover element that at least partially surrounds said shaft and is closely adjacent to said door, when said cover element is in said position.

11. The combination of claim 9 in which said mounting means is a hinge that mounts said cover element on said door and permits the cover element to swing on said hinge to a position that allows a human hand to have access to said portion.

12. The combination of claim 11 including magnetic means for tending to hold said cover element in said position.

13. The combination of claim 11 in which said door includes materials that is attracted by a magnet, and a magnet on said cover element which contacts said door when said cover element is in said position.

14. The combination of claim 11 in which said cover element has side walls means that at least partly surrounds the space between said cover element and said door, said mounting means comprising hinge means for connecting said cover element to said door while allowing said cover element to swing to and away from said position, said door including material that is attracted by a magnet, and a magnet mounted on said side wall means for engaging said door when said cover element is in said position so that the magnet tends to hold said cover element in said position once said cover element is in said position.

15. The combination of claim 14 including a hook mounted on said portion of said door.

16. The combination of claim 14 having a lock mounted on said portion of said door, said lock having an elongated handle positioned at an acute angle to the horizontal when the lock is locked, and means for preventing said handle from turning comprising an element defining a slot for receiving said handle and having a portion engaging said shaft of said door-knob, so that if an attempt is made to unlock said lock the handle will cause said element to bear against said shaft to prevent rotation of said handle.

17. In combination:

a door having a door-knob with a shaft, a lock for said door having a handle that is elongated in a plane parallel to said door, said handle being rotatable to unlock said lock, and means manually insertable on said handle to prevent it from rotating, comprising an element having an indent for receiving said handle and also having a curved portion that engages said shaft when said lock is locked and thereby prevents rotation of said handle, said portion being curved to increase its contact with said shaft.

18. The combination of claim 17 in which said element has limited flexibility to enable the element to be inserted on said handle but having sufficient stiffness to prevent rotation of said handle.

19. A device as defined in claim 9 in which there is a door jamb adjacent said door, said cover element covering said portion of said door and also that part of the door jamb that is adjacent to said portion of said door.

20. A device as defined in claim 9, in which said cover element comprises means for substantially completely obscuring the visibility of any locking devices that may be located on the door, above the door knob of the door, and within a given distance of the door knob.

* * * * *